United States Patent [19]

Okumura et al.

[11] Patent Number: 4,517,719

[45] Date of Patent: May 21, 1985

[54] MAGNETIC ROLLS FOR ELECTROSTATIC RECORDING DEVICES

[75] Inventors: Kunio Okumura, Hachioji; Yasuo Fukuyama, Uji; Atsuo Tanaka, Yawata, all of Japan

[73] Assignee: Yamauchi Rubber Industry Co., Ltd., Osaka, Japan

[21] Appl. No.: 368,998

[22] Filed: Apr. 16, 1982

[30] Foreign Application Priority Data

Apr. 20, 1981 [JP] Japan ..... 56-59958
Mar. 12, 1982 [JP] Japan ..... 57-39916

[51] Int. Cl.[3] ..... B21B 27/00
[52] U.S. Cl. ..... 29/124; 29/125; 29/132
[58] Field of Search ..... 29/124, 125, 129, 132; 118/623, 657

[56] References Cited

U.S. PATENT DOCUMENTS

| | | | |
|---|---|---|---|
| 3,742,852 | 7/1973 | Leffler et al. | 29/125 X |
| 3,945,343 | 3/1976 | Berkowitz | 118/623 |
| 4,142,281 | 3/1979 | Müller | 29/116 R |
| 4,293,989 | 10/1981 | Schneider | 29/132 X |
| 4,354,454 | 10/1982 | Nishikawa | 118/658 |

FOREIGN PATENT DOCUMENTS

| | | | |
|---|---|---|---|
| 86368 | 1/1975 | Japan | 29/132 |

*Primary Examiner*—Howard N. Goldberg
*Assistant Examiner*—Timothy V. Eley
*Attorney, Agent, or Firm*—Hubbell, Cohen, Stiefel & Gross

[57] ABSTRACT

A magnetic roll having a plurality of magnets integrally set fast with a retaining member at stated portions of the periphery of a roll shaft thereby forming a magnetic force generating part, in which the retaining member is made from a rigid synthetic resin or resin foam, and optionally a strain absorbing groove is provided at a portion outside of said magnetic force generating part.

5 Claims, 10 Drawing Figures

MAGNETIC ROLLS FOR ELECTROSTATIC RECORDING DEVICES

BACKGROUND OF THE INVENTION

1. Field of the Invention

This invention relates to a magnetic roll to be used for magnetic brush development mainly in electrostatic recording devices such as copying machines, facsimiles, and printers and to a method for the manufacture of the magnetic roll.

2. Description of the Prior Art

The magnetic brush development in an electrostatic recording system is accomplished by mounting a sleeve of non-magnetic substance on the outer surface of a magnetic roll incorporating permanent magnets, causing a developing agent such as a magnetic toner to adhere to the periphery of the sleeve thereby forming a magnetic brush, then allowing the sleeve to move relative to a photosensitive material thereby causing the produced electrostatic latent image to be rubbed against the photosensitive material.

For the sake of the magnetic brush development described above, there has been conventionally used a magnetic roll which has a plurality of disk retaining flanges fastened to the periphery of a roll shaft and a plurality of bar-shaped sintered ferrite magnets of alternately opposed poles held in position on the retaining flanges.

The magnetic roll of this construction, however, is required to meet certain level of accuracy with respect to the attachment of the magnets. In the manufacture of this magnetic roll, therefore, particularly the work of attaching the retaining flanges to the roll shaft and the work of attaching the magnets to the retaining flanges call for very much time and labor. Besides, the fastening of the magnets to the retaining flanges with an adhesive agent is difficult to achieve. The magnetic roll as a whole is complicated in construction, heavy, and difficult to handle. Moreover, it is costly.

Various improvements intended to overcome the disadvantages mentioned above have been proposed. See, e.g., Japanese Utility Model Application Disclosure No. 16905/1981, etc. They are, however, not free from problems.

Japanese Patent Application Disclosure No. 100581/1980 teaches a magnetic transfer roll having a layer of elastic substance formed on the periphery of a roll shaft and a layer of magnetic substance formed on the periphery of the layer of elastic substance. Since the magnetic transfer roll is required to deform while the magnetic transfer is in process, it necessitates use of the elastic layer which is formed of a soft, resilient substance such as sponge. The flexible, elastic layer, however, is not believed to retain magnets such as sintered magnets in position with high accuracy.

The prior art of this invention further embraces U.S. Pat. Nos. 3,364,545, 3,457,618, 3,945,343, and 4,155,328, for example.

SUMMARY OF THE INVENTION

An object of this invention is to provide a magnetic roll which is very easy to manufacture and has a very simple construction, giving a solution to the disadvantages suffered by the conventional magnetic rolls.

To be specific, this invention provides a magnetic roll of the type having a plurality of magnets integrally set fast with a retaining member at stated portions of the periphery of a roll shaft thereby forming a magnetic force generating part, which magnetic roll is characterized by having the retaining member in the form of a retaining layer made of rigid synthetic resin or rigid synthetic resin foam.

In another aspect, this invention provides a magnetic roll of the type having a plurality of magnets integrally set fast with a retaining member at stated portions of the periphery of a roll shaft thereby forming a magnetic force generating part, which magnetic roll is characterized by having the retaining member in the form of a retaining layer made of rigid synthetic resin or rigid synthetic resin foam and further having a strain absorbing groove formed at a portion outside said magnetic force generating part.

The hardness of the retaining layer is such that the plurality of magnets are prevented from producing positional deviation owing to their mutual attraction and the layer itself keeps its shape intact for a long time. It is suitable to fall in the range of about 40 to about 95, preferably about 50 to about 80, and most preferably about 60 to about 70, on the Shore Hardness Scale. The term "Shore hardness" as used herein refers to the values measured by the Shore hardness meter, type D.

Another object of this invention is to provide a method for the manufacture of the magnetic roll described above.

To be specific, this invention further provides a method for the manufacture of a magnetic roll, which method comprises setting a middle metal mold containing a circular hole on a lower metal mold provided with a cylindrical base containing a roll shaft insertion hole at the center and a plurality of magnet insertion grooves at stated portions of the periphery thereof, then inserting a roll shaft into said roll shaft insertion hole and, at the same time, inserting magnets into said magnet insertion grooves and setting them upright within said circular hole of said middle metal mold, subsequently setting an upper metal mold possessing a cylindrical base substantially similar to said cylindrical base of said lower metal mold and containing a synthetic resin injection hole on said middle metal mold and closing these metal molds tightly, thereafter pouring the raw material of synthetic resin or synthetic resin foam for the production of a retaining layer through said synthetic resin injection hole, allowing the injected raw material to cure and form a retaining layer, and separating the metal molds thereby obtaining a magnetic roll having the plurality of magnets integrally set fast with the retaining layer made of a rigid synthetic resin or resin foam on the periphery of the roll shaft.

In another aspect, this invention provides a method for the manufacture of a magnetic roll, which method comprises setting a middle metal mold possessing a circular hole containing magnet retaining grooves at stated portions of the wall thereof on a lower metal mold provided with a cylindrical base possessing a roll shaft insertion hole at the center thereof, then inserting a roll shaft into said roll shaft insertion hole and, at the same time, inserting magnets into said magnet retaining grooves and setting them upright within said circular hole of said middle metal mold, subsequently setting an upper metal mold possessing a cylindrical base substantially similar to said cylindrical base of said lower metal mold and containing a synthetic resin injection hole on said middle metal mold and closing these metal molds tightly, thereafter pouring the raw material of synthetic resin or synthetic resin foam for the production of a retaining layer through said synthetic resin injection hole, allowing the injected raw material to cure and form a retaining layer, and separating the metal molds thereby obtaining a magnetic roll having the plurality of magnets integrally set fast with the retaining layer made of the rigid synthetic resin or resin foam on the periphery of the roll shaft.

One of the characteristics of the magnetic roll of the present invention resides in the fact that the attachment of magnets to the roll shaft is accomplished through the medium of a retaining layer made of a rigid synthetic resin or resin foam. Owing to this particular characteristic, the magnetic roll of this invention is manufactured decisively easily as compared with the conventional magnetic roll and enjoys a notable reduction in weight.

The accuracy with respect to the attachment of magnets is the reason for the lower limit, about 40 of Shore hardness. Above this level, the stability of the attachment of magnets is secured. The upper limit, about 95 of Shore hardness, is desired from some aspects.

Another characteristic of the magnetic roll of the invention resides in the fact that the groove for the absorption of strain is formed in the portion of the retaining layer outside the portion where the magnets are attached to form the magnetic force generating part. Concerning the retention of the magnets, while the aforementioned characteristic provides mechanical stability, the present characteristic serves to ensure thermal stability.

One of the characteristics of the method for the manufacture of this magnetic roll according to the present invention resides in the fact that the production of the retaining layer of synthetic resin or synthetic resin foam is effected by the casting process and, in consequence of the curing of the molten resin or resin foam, the roll shaft, the retaining layer, and the magnets are powerfully set integrally. Since the integration of all these components takes place while the positional relationship between the roll shaft and the magnets is accurately retained intact within the metal mold, the magnetic roll to be produced will enjoy high dimensional accuracy.

DETAILED DESCRIPTION OF PREFERRED EMBODIMENTS

Figure 1:
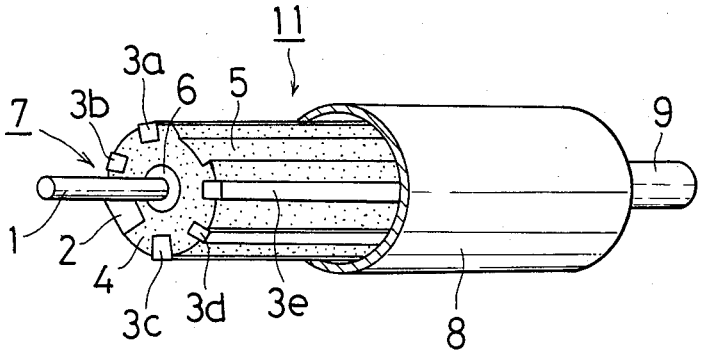
FIG. 1 is a partially cutaway perspective view of a magnetic brush developing roll incorporating one embodiment of the magnetic roll according to this invention.
Figure 2:
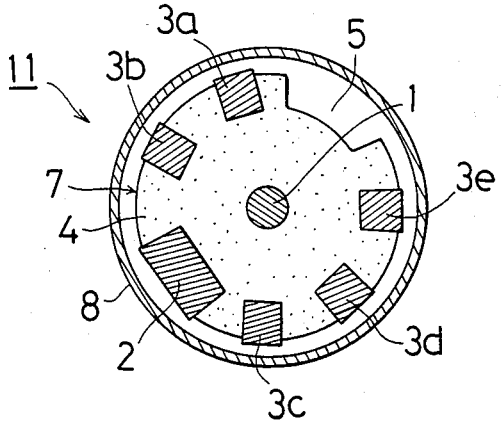
FIG. 2 is a vertical cross section of the same magnetic brush developing roll.
Figure 3:
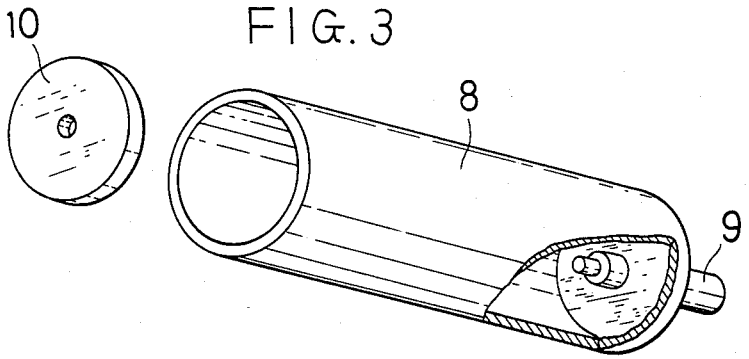
FIG. 3 is a perspective view of a non-magnetic sleeve for use on the magnetic brush developing roll illustrated in FIG. 1.

In FIG. 1, 11 denotes a typical magnetic brush developing roll, which incorporates a typical magnetic roll 7 of the present invention.

For a roll shaft 1, a non-magnetic substance such as aluminum, stainless steel, or synthetic resin and a magnetic substance such as iron, Permalloy, or a mixture of synthetic resin such as with barium ferrite are used. Between the magnetic and non-magnetic substances mentioned above, it is desirable to use the magnetic substance from the standpoint of the formation of magnetic circuit, specifically from the standpoint of enhancing the coefficient of pereance, diminishing the leakage of magnetic flux, and improving the capacity for magnetizing treatment. The roll shaft may be solid or hollow.

The retaining layer 4 can be formed of any of thermosetting resins such as epoxy resin, urea resin, phenol resin, unsaturated polyester resin, melamine resin, silicone resin, diallylphthalate resin, and polyurethane resin; thermoplastic resins such as polyolefin, polyethylene, polyvinyl chloride, fluorine resin, acrylic resin, polyamide resin, polystyrene, and polycarbonate; thermosetting foams such as epoxy resin foam, urea resin foam, phenol resin foam, silicone resin foam, and polyurethane resin foam; and thermoplastic foams such as polyolefin foam, polyethylene foam, polyvinyl chloride foam, acrylic resin form, polyamide resin foam, and polystyrene foam.

For the sake of weight reduction, it is desirable to use a synthetic resin foam. Particularly in view of the ease of manufacture, it is most desirable to form the retaining layer 4 with a polyurethane foakm by the reaction injection molding process (hereinafter called as RIM foam urethane).

When the retaining layer 4 is formed of a synthetic resin foam, the expansion ratio is suitably selected within the range of 1.2 to 3.5.

When the expansion ratio is less than 1.2, much of the synthetic resin foam material is required and the retaining layer formed thereby is not desired from the viewpoint of thermal deformation. While if the expansion rate is greater than 3.5, the formed retaining layer would be weaker in strength because it has more voids. Particularly from the standpoint of strength and thermal strain, the expansion ratio is desired to fall in the range of 1.8 to 2.5.

Selection of the epoxy resin, the polyester resin, etc. for the retaining layer 4 proves advantageous in respect that the retaining layer 4 can be formed under atmospheric pressure.

In the retaining layer 4, magnets 2, **3*a*–3*e* are set fast in position. If the magnets 2, 3*a*–3*e*** are suffered to produce any positional deviation, then the magnetic brush developing roll will have its copying property affected accordingly. For this reason, the accuracy with which the magnets 2, 3*a*–3*e* are attached to the retaining layer 4 has its significance. In this respect, use of a soft synthetic resin or synthetic resin foam as the material for the retaining layer 4 should be avoided. Since the plurality of magnets 2, 3*a*–3*e* have a strong magnetic force and they are parallelly disposed with their opposite poles alternately arranged, power attraction is exerted at all times on these magnets. If the retaining layer 4 is made of a material abounding with elasticity, therefore, the retaining layer 4 is gradually deformed by the aforementioned attracting force and the positions at which the magnets 2, 3*a*–3*e* are disposed are accordingly changed. As the result, the developer attracting property is affected and the copying property is adversely affected. From this point of view, an elastic material which is readily deformed should not be adopted as the material for the retaining layer 4. The material to be selected, therefore, is desired to have at least about 40 of Shore hardness.

Figure 9:
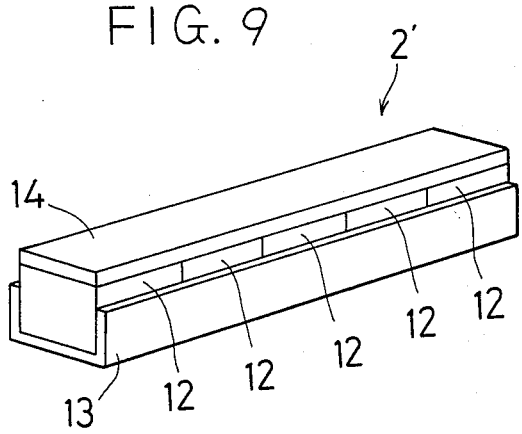
FIG. 9 is a perspective view of an integrated series of short magnets useful for the manufacture of the magnetic roll of the present invention.

The magnets 2, 3*a*–3*e* include a magnet 2 for attracting the developing agent such as a magnetic toner, and magnets 3*a*–3*e* for retaining the attracted developing agent. As the magnet 2 for the attraction of the developing agent, a bar-shaped sintered ferrite magnet, alnico magnet, or rare earth magnet having powerful magnetic force can be used. When necessary, a keeper of magnetic substance to be used for forming a magnetic circuit may be disposed on the rear side of this magnet 2. As the magnets 3*a*–3*e* for the retention of the attracted developing agent such as a magnetic toner, bar-shaped ferrite magnets similar to the magnet 2 for the attraction of the developing agent, or plate-shaped ferrite magnets or sheet-shaped composite magnets can be used. Although a long one-piece sintered magnet is advantageously used as the bar-shaped sintered magnet, a combined magnet 2′ which is formed by having a plurality of short sintered magnets 12 held in position within a trough-shaped holder 13 of non-magnetic substance and a sheet-shaped composite magnet 14, for example, mounted on the upper surface of the short sintered magnets as illustrated in FIG. 9 may be economically used. The sheet-shaped composite magnet 14 is used here for the purpose of conpensating the lowering of magnetic force between the short sintered magnets. In this case, the upper surface of the sheet-shaped composite magnet 14 constitutes itself part of the peripheral surface of the magnetic roll 7. The sheet-shaped composite magnet 14 is made, for example, of elastic rubber component and magnetic substance component in accordance with the conventional manner. The combination of the plurality of short sintered magnets 12 may be effected by use of an adhesive agent instead of the holder 13.

The expression "stated portions" of the retaining layer 4 at which the magnets 2, 3*a*–3*e* are set fast is used to refer to part of the peripheral surface and not the entire peripheral surface of the retaining layer 4. In the part of the peripheral surface, the magnets 2, 3*a*–3*e* are set fast integrally in the retaining layer 4 in such an arrangement that the developing agent such as a magnetic toner will be attracted and uniformly retained. The arrangement of magnets which is well known in the art can be suitably used for effective arrangement of the magnets 2, 3*a*–3*e*.

The portions in which the magnets 2, 3*a*–3*e* are set fast in the retaining layer form a magnetic force generating part, which functions to attract and retain the magnetic toner, for example.

In a portion of the retaining layer outside the magnetic force generating part, there is formed a groove 5 for the absorption of strain instead of a magnet. No magnet is provided in this particular portion because no magnetic force is required in recovering the residual magnetic toner which has escaped being used for the development. The groove 5 for the absorption of strain is provided here for the purpose of precluding the phenomenon that the roll is bent by the difference in thermal strain between the magnetic force generating part incorporating the magnets 3*a*–3*e* and the part incorporating no magnet and the phenomenon that the retaining layer 4 and the magnets 2, 3*a*–3*e* separate from each other along their interface.

The shape, width, depth, etc. of the groove 5 are determined by the use to be found for this invention, the diameter of roll, the thickness of the retaining layer 4, etc. A typical groove has a cross section of the shape of the letter U of a shallow bottom and is disposed in the axial direction. In other word, the grooves to be cited afterward in the embodiments may be suitably modified in shape, width, and depth. The groove 5 is not limited to the cited shapes and sizes. It is only required to possess shape, width, and depth such that the difference of thermal deformation between the synthetic resin or synthetic resin foam of the retaining layer 4 and the magnets (normally sintered magnets) 2, 3*a*–3*e*, i.e. the two different materials are absorbed.

Generally, only one groove 5 suffices. Optionally, two or more such grooves may be disposed.

By 6 is denoted a slider.

Denoted by 8 is a non-magnetic sleeve made of such a material as aluminum, stainless steel, and it is concentrically set on the periphery of a magnetic roll 7.

By 9 is denoted a rotary shaft and by 10 a lid plate.

As is plain from the description given above, the magnetic roll 7 comprises a plurality of magnets 2, 3*a*–3*e* set fast in stated portions of the roll shaft 1 with a retaining layer 4 having a Shore hardness of about 40 to about 95 and a groove 5 for the absorption of thermal strain formed in a portion of the retaining layer outside the aforementioned stated portions. Compared with the conventional magnetic roll which uses disk retaining flanges, the magnetic roll 7 of the embodiment can be manufactured decisively easily and less expesively and can be used effectively in a wider range of temperatures (as between −25° C. and +70° C., for example). In other words, the magnetic roll 7 can be operated in a wide range of temperatures without generating any warp or bend. When this magnetic roll 7 is used in the magnetic brush developing roll 11, the uniformity of the magnetic force on the periphery of the sleeve 8 and consequently the copying ability can be retained at high levels because the gap between the periphery of the roll 7 and the non-magnetic sleeve 8 mounted concentrically on the periphery of the roll 7 can be minimized to the fullest possible extent.

Typically, the components which make up the magnetic roll 7 and the sizes of such components are as follows.

Roll shaft 1, made of iron and measuring 8 mm in diameter and 334 mm in length.

Magnet 2, sintered ferrite magnet measuring 12 mm×12 mm×292 mm.

Magnets 3*b* and 3*c*, sintered ferrite magnets measuring 6 mm×6 mm×292 mm.

Magnets 3*a*, 3*d*, 3*e*, rubber magnets measuring 6 mm×6 mm×292 mm.

Retaining layer 4, made of polyurethane foam (formed by the reaction injection molding process), having an expansion ratio of 2.5 and Shore hardness of 67, and measuring 47 mm in outside diameter and 292 mm in length.

Groove 5, having a cross section of the shape of the letter U, and measuring 28 mm in width×8.5 mm in depth×292 mm in length.

Figure 4:
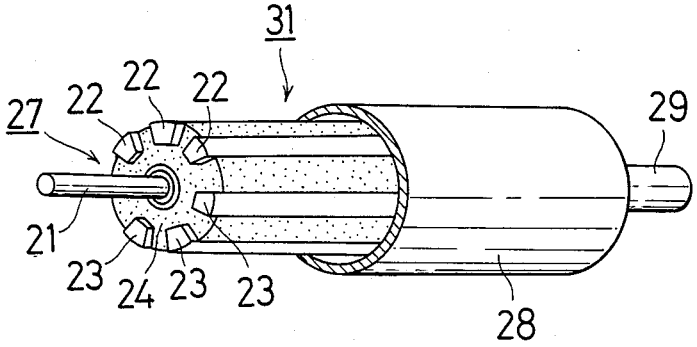
FIG. 4 is a diagram illustrating, similarly to FIG. 1, a magnetic brush developing roll incorporating another embodiment of the magnetic roll according to the present invention.

In the diagram of FIG. 4, 27 denotes another embodiment of the magnetic roll of the present invention. This magnetic roll 27 comprises a roll shaft 21, a plurality of anisotropic bar-shaped magnets 22 for attracting the magnetic toner, a plurality of anisotropic bar-shaped magnets 23 for retaining the attracted magnetic toner, and a retaining layer 24 of foamed urethane for integrally retaining such magnets in position. Unlike the magnetic roll of the precedingf embodiment, the magnetic roll in this embodiment has no groove formed therein.

On the periphery of this magnetic roll 27, a sleeve 28 of non-magnetic substance (aluminum) having a coarse surface and provided at one end thereof with a rotary shaft 29 is concentrically mounted, to complete a magnetic brush developing roll 31.

Figure 5:
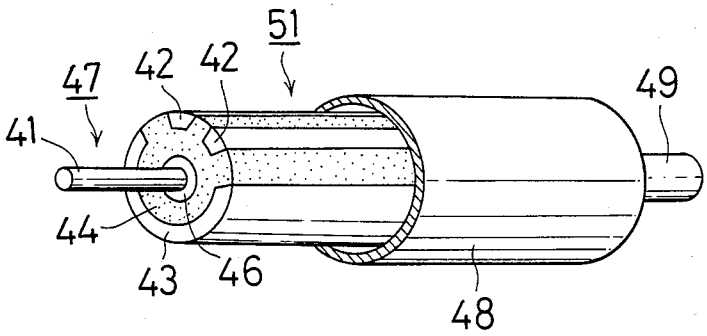
FIG. 5 is a diagram illustrating, similarly to FIG. 1, a magnetic brush developing roll incorporating yet another embodiment of the magnetic roll according to the present invention.

In the diagram of FIG. 5, 47 denotes yet another embodiment of the magnetic roll of this invention. This magnetic roll 47 comprises a roll shaft 41, anisotropic bar-shaped magnets 42 for attracting the magnetic toner, an anisotropic sheet-shaped semicylindrical magnet 43 for retaining the attracted magnetic toner, and a retaining layer 44 of epoxy resin for integrally retaining such magnets in position.

On the periphery of this magnetic roll 47, a sleeve 48 of non-magnetic substance (aluminum) having a coarse surface and provided at one end thereof with a rotary shaft 49 is concentrically mounted, to complete a magnetic brush developing roll 51.

Figure 6:
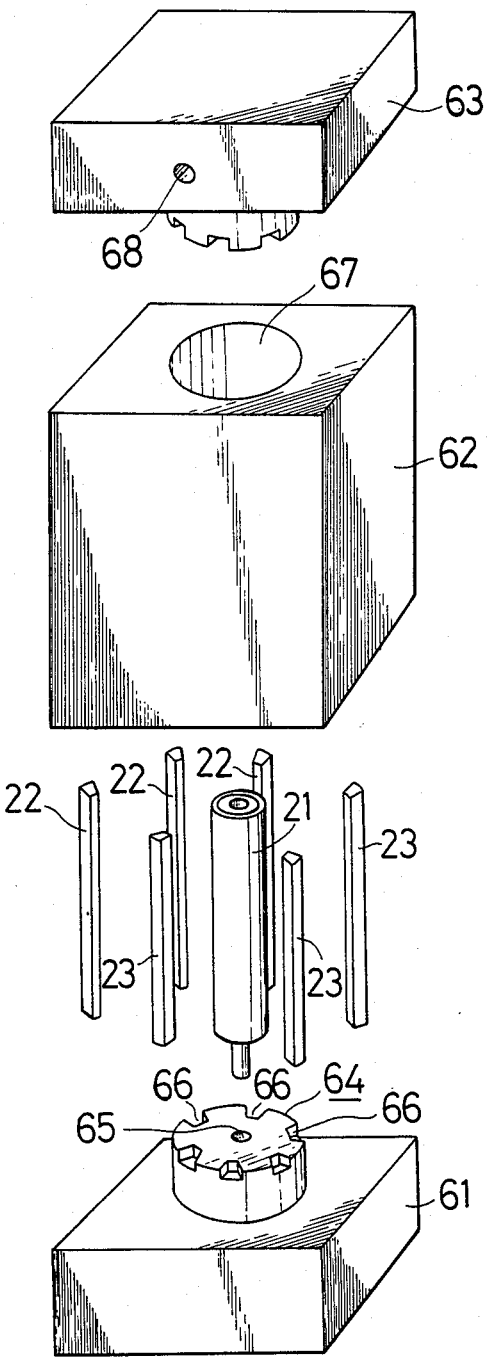
FIG. 6 is an exploded perspective view of metal molds and relevant parts, illustrating the condition in which the magnetic roll shown in FIG. 4 is manufactured.
Figure 7:
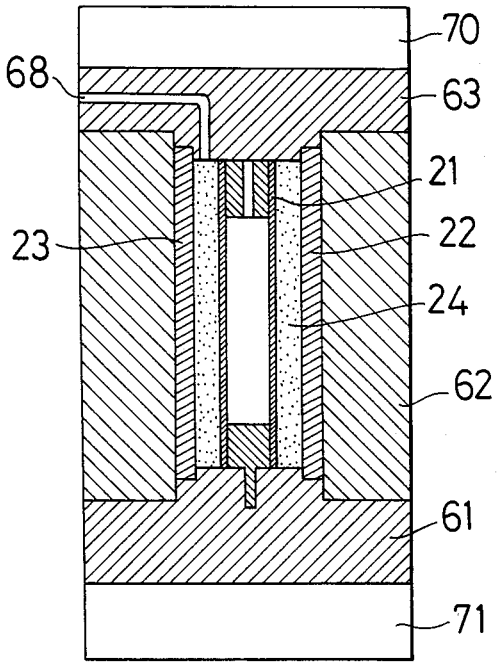
FIG. 7 is a vertical cross section of metal molds and relevant parts, illustrating the condition in which synthetic resin has been introduced into the cavity of the mold.

Now, the method for the manufacture of the aforementioned magnetic roll 27 will be described with reference to FIG. 6 and FIG. 7.

(i) A middle metal mold 62 is mounted on a lower metal mold 61.

(ii) The roll shaft 21 having adhesive agent applied thereto is inserted into a roll shaft insertion hole 65 in a cylindrical base 64 of the lower metal mold 61 and raised upright inside a circular hole 67 of the middle metal mold 62.

(iii) Then, the anisotropic bar-shaped magnets 22, 23 are inserted respectively into the magnet insertion grooves 66 formed in the base 64 of the lower metal mold 61 and raised upright, similarly to the roll shaft 21, within the circular hole 67 of the middle metal mold 62.

(iv) An upper metal mold 63 is placed on top of the middle metal mold 62, and all the metal molds and closed tightly by means of a press 70, 71.

(v) Subsequently, the raw materials for RIM foam urethane, namely, (1) 100 parts by weight of polyol (made by Sumitomo Bayer Urethane Ltd. and marketed under trademark designation of Desmophen B631), (2) 110 parts by weight of isocyanate (made by the same company as described above and marketed under trademark designation of Desmodur 44 V20), and (3) 12 parts by weight of a foaming agent (made by Mitsui-Fluoro Chemical Ltd., and marketed under trademark designation of Freon 11)

are mixed and injected by a high-pressure reaction injector through an injection hole 68 of the upper metal mold 63. The molten mixture in the mold is heated at 60° C. for 10 minutes to be cured. Thereafter, the upper metal mold 63, the middle metal mold 62, and the lower metal mold 61 are opened to release a magnetic roll 27 having the magnets 22, 23 retained at the stated positions to the roll shaft by means of a RIM foam urethane layer 24 of Shore Hardness 60.

By concentrically inserting the magnetic roll 27 thus produced into the interior of the aluminum sleeve 28 and then fitting the lid plate in position, there is obtained a magnetic brush developing roll 31.

Figure 8:
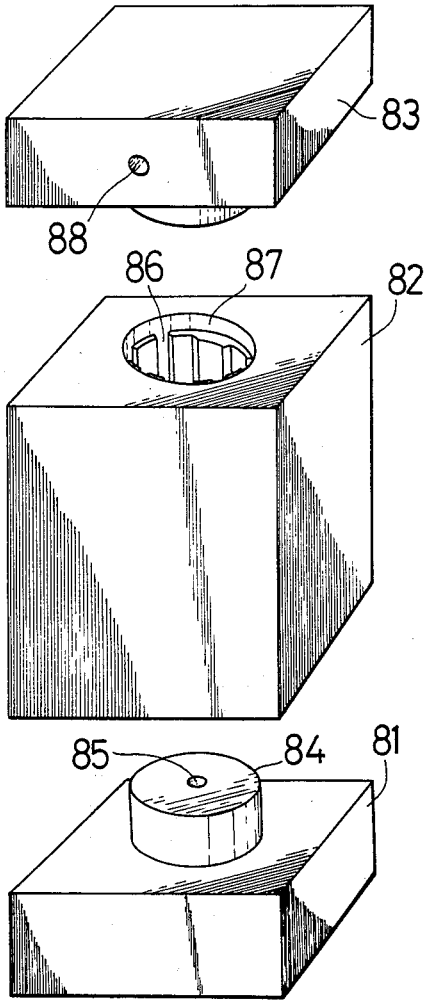
FIG. 8 is an exploded perspective view of a metal mold to be used for the manufacture of the magnetic roll shown in FIG. 1.

The magnetic roll 7 illustrated in FIG. 1 and the magnetic roll 47 illustrated in FIG. 5 are manufactured by the same procedure as described above. It is provided, however, that the shape of metal molds to be used may be suitably changed. For the magnetic roll 7, for example, such metal molds 81, 82, 83 as illustrated in FIG. 8 are used. The materials for synthetic resin and the method for curing the synthetic resin may be suitable changed. For the magnetic roll 47, for example, an epoxy resin solution (mixture of 100 parts by weight of Araldite GY-252 and 23 parts by weight of HY 2962, curing agent, both made by Giba Geigy Japan Ltd.) is used. This mixture is injected into the metal mold and then cured by being heated at 60° C. for 40 minutes.

In FIG. 8, 84 denotes a base, 85 circular hole for erecting a roll shaft, 87 a circular hole, 86 grooves for retaining magnets, and 88 an injection hole.

Figure 10:
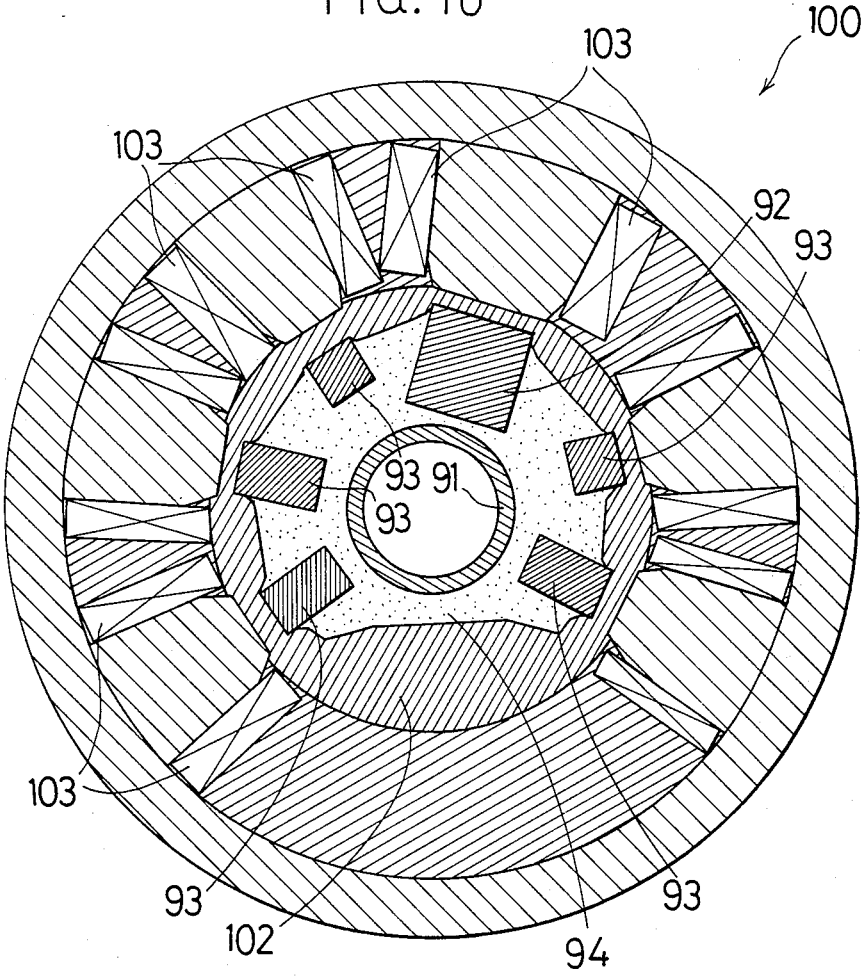
FIG. 10 is a cross section of a metal mold serving concurrently for molding and magnetization.

In the method for the manufacture of the magnetic roll described above, the magnets may be used in a form magnetized in advance. Otherwise, they may be set fast to the roll in a form not yet magnetized. After the retaining layer has been cured, the roll now complete integrally with the magnets and the retaining layer is removed from the metal mold, set in position within a magnetizing metal mold and subjected to magnetization, to produce a complete magnetic roll. It is likewise to adopt metal molds illustrated in FIG. 10. In this case, the magnets 92, 93 in a state not yet magnetized can be magnetized within the metal molds 100 immediately after the retaining layer 94 has been cured therein. In FIG. 10, 91 is a roll shaft, 102 is a nitrided mold, and 103 is a magnetizing coil.

What is claimed is:

1. A magnetic roll for electrostatic recording devices comprising a plurality of magnets integrally set fast with a retaining member at stated portions of the periphery of a roll shaft, each of said magnets extending longitudinally along a line parallel to the roll shaft axis for forming a magnetic force generating part, wherein said retaining member comprises a retaining layer formed of a synthetic resin material having a hardness in the range of 40 to 95 on the Shore Hardness Scale and a strain absorbing groove extending longitudinally along a line parallel to the roll shaft axis at a portion outside said magnetic force generating part for preventing the roll from bending as a result of the difference in thermal strain between the magnetic force generating part of the roll and the non-magnetic part of the roll.

2. The magnetic roll according to claim 1, wherein said retaining layer has a hardness in the range of 50 80 on the Shore Hardness Scale.

3. The magnetic roll according to claim 1, wherein said synthetic resin material of said retaining layer is a thermosetting foam taken from the group consisting of epoxy resin foam, urea resin foam, phenol resin foam, silicone resin foam and polyurethane resin foam.

4. The magnetic roll according to claim 1, wherein said synthetic resin material of said retaining layer is a thermoplastic foam taken from the group consisting of polyolefin foam, polyethylene foam, polyvinyl chloride foam, acrylic resin foam, and polyamide foam.

5. The magnetic roll according to claim 1, wherein said magnets each comprise jointly sintered magnets having a plurality of short bar-shaped sintered magnets arranged serially within a trough-shaped holder, said holder being open along one side exposing said bar-shaped sintered magnets, and a sheet-shaped composite magnetic piece for covering the open side of said holder and said exposed bar-shaped sintered magnets, said composite magnetic piece being in contact with said short bar-shaped sintered magnets.

* * * * *